US007363992B2

(12) United States Patent
Stowe et al.

(10) Patent No.: US 7,363,992 B2
(45) Date of Patent: Apr. 29, 2008

(54) CUTTERS FOR DOWNHOLE CUTTING DEVICES

(75) Inventors: Calvin Stowe, Bellaire, TX (US); James McNicol, The Woodlands, TX (US)

(73) Assignee: Baker Hughes Incorporated, Houston, TX (US)

( * ) Notice: Subject to any disclaimer, the term of this patent is extended or adjusted under 35 U.S.C. 154(b) by 21 days.

(21) Appl. No.: 11/483,154

(22) Filed: Jul. 7, 2006

(65) Prior Publication Data

US 2008/0006446 A1 Jan. 10, 2008

(51) Int. Cl.
*E21B 10/46* (2006.01)

(52) U.S. Cl. ..... 175/426; 175/430

(58) Field of Classification Search ..... 175/378, 175/426, 428, 430, 434
See application file for complete search history.

(56) References Cited

U.S. PATENT DOCUMENTS

| | | | | |
|---|---|---|---|---|
| 5,421,423 | A * | 6/1995 | Huffstutler | 175/374 |
| 5,647,449 | A * | 7/1997 | Dennis | 175/434 |
| 6,053,263 | A * | 4/2000 | Meiners | 175/331 |
| 6,065,554 | A * | 5/2000 | Taylor et al. | 175/430 |
| 6,283,234 | B1 * | 9/2001 | Torbet | 175/432 |
| 6,612,383 | B2 * | 9/2003 | Desai et al. | 175/61 |
| 2003/0111273 | A1 * | 6/2003 | Richert et al. | 175/426 |
| 2003/0188896 | A1 * | 10/2003 | Minikus et al. | 175/374 |

* cited by examiner

*Primary Examiner*—Jennifer H. Gay
*Assistant Examiner*—Daniel P Stephenson
(74) *Attorney, Agent, or Firm*—Shawn Hunter

(57) ABSTRACT

Improved cutter design as well as an improved design for downhole cutters, such as mandrel cutters and rotary cutter mills. A cutter is described with a rectangular, rounded "lozenge" shape. The cutter presents a cross-sectional cutting area having a pair of curvilinear end sections and an elongated central section. Preferably, the overall length of the cutter is 1.5 times the width. The cutter may also include a raised cutter edge for chip breaking during cutting.

23 Claims, 4 Drawing Sheets

Fig. 5
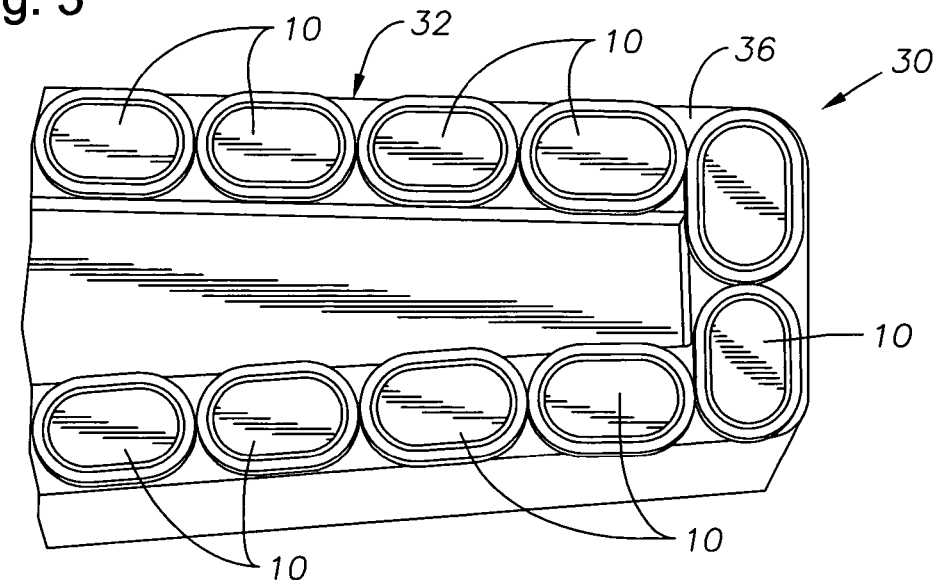
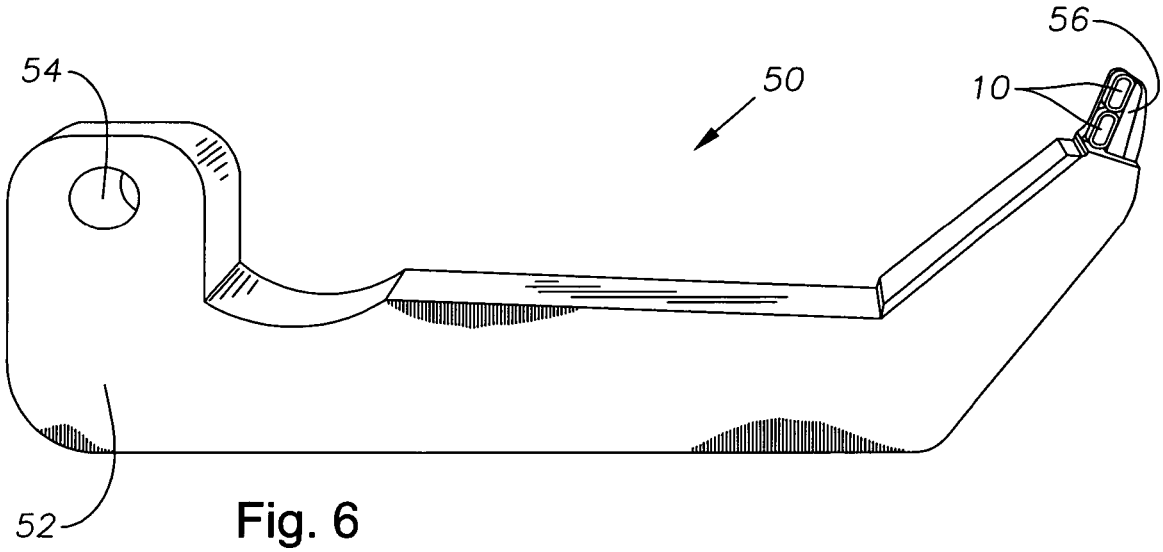
Fig. 6
Fig. 6A
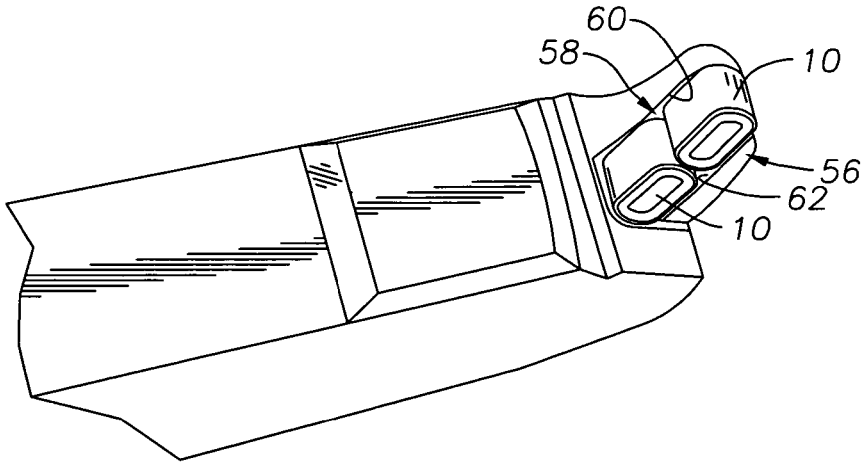

CUTTERS FOR DOWNHOLE CUTTING DEVICES

BACKGROUND OF THE INVENTION

1. Field of the Invention

The invention relates generally to the design and use of cutters for the cutting arms and blades of underreamers, mills and other downhole tools.

2. Description of the Related Art

Rotary cutting mills and mandrel cutters are devices that are incorporated into a drill string and used to cut laterally through metallic tubular members, such as casing on the sides of a wellbore, liners, tubing, pipe or mandrels. Mandrel cutters are used to create a separation in metallic tubular members. Cutting mills are tools that are used in a side-tracking operation to cut a window through surrounding casing and allow drilling of a deviated drill hole. On conventional tools of this type, numerous small individual cutters are attached to multiple arms or blades that are rotated about a hub. Most conventional cutters present a circular cutting face. Other conventional cutter shapes include square, star-shaped, and trapezoidal, although these are less common. However, the use of circular cutters has some inherent drawbacks when used to cut through metallic tubular members. First, there is a small amount of bond area between the cutter and the arm or blade upon which the cutter is mounted. The bond area is essentially the area of the circle. During cutting, the cutters may become loose and break off of the cutting arm. Additionally, the geometry of circular cutters results in a significant amount of interstitial space between cutters. This is detrimental, particularly, when the cutter is cutting through metal that is ductile, such as casing containing high amounts of chrome and/or nickel. These materials will enter the interstitial spaces and erode away the cutting arm during cutting.

In the instance of a rotary cutting mill, the presence of large interstitial spaces also presents a significant problem because of the cutting pattern provided by the mill. As the mill is rotated, the cutters are caused to cut repeatedly along particular paths in the material being cut. This repeated pattern of cutting will result in grooves in the cut material and undesirably force the uncut portions of the material lying between the grooves into the interstitial spaces. To prevent this from happening, half-circular cutters have been used on alternate blades to provide an offset. However, these half-cutters have little bonding area and are prone to breaking off.

Mandrel cutters have at least one cutting knife that is rotated to cut circumferentially through a surrounding metallic tubular member. Mandrel cutters are problematic because they require the use of cutting portions that are very small and narrow in order to effectively cut through the mandrel. The limitation on the size of the cutting portion exacerbates the bonding area problem described above.

The present invention addresses the problems of the prior art.

SUMMARY OF THE INVENTION

The invention provides an improved cutter design as well as an improved design for downhole cutters, for use with cutting devices such as mandrel cutters, and rotary cutter mills. In one aspect, the invention describes an improved cutter having a rectangular, rounded "lozenge" shape. The cutter may be formed of carbide or be a polycrystalline diamond compact ("PDC") cutter. The cutter presents a cross-sectional cutting area having a pair of curvilinear, and preferably arcuate, end sections and an elongated central section having substantially straight or flat sides. Preferably, the overall length of the cutter is 1.5 times the width. In a preferred embodiment, the cutter includes a raised cutter edge for chip breaking during cutting.

The cutters of the present invention provide advantages for attachment to a cutter arm or blade. Bond area is increased. Therefore, the cutters remain in place more securely. Also, placement of the rounded, rectangular cutters on a cutting arm results in less interstitial space between cutters. In return, this results in less extrusion of ductile metals into the interstitial spaces and less resultant damage to the arm or blade carrying the cutters.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein:

FIG. 5 is an illustration of an exemplary cutting arm for a downhole cutter having secured thereupon a plurality of cutters of the type shown in FIGS. 1 and 2.

FIGS. 6 and 6A depict an exemplary mandrel cutting arm with cutters of the type shown in FIGS. 1 and 2.

DETAILED DESCRIPTION OF THE PREFERRED EMBODIMENTS

Figure 1:
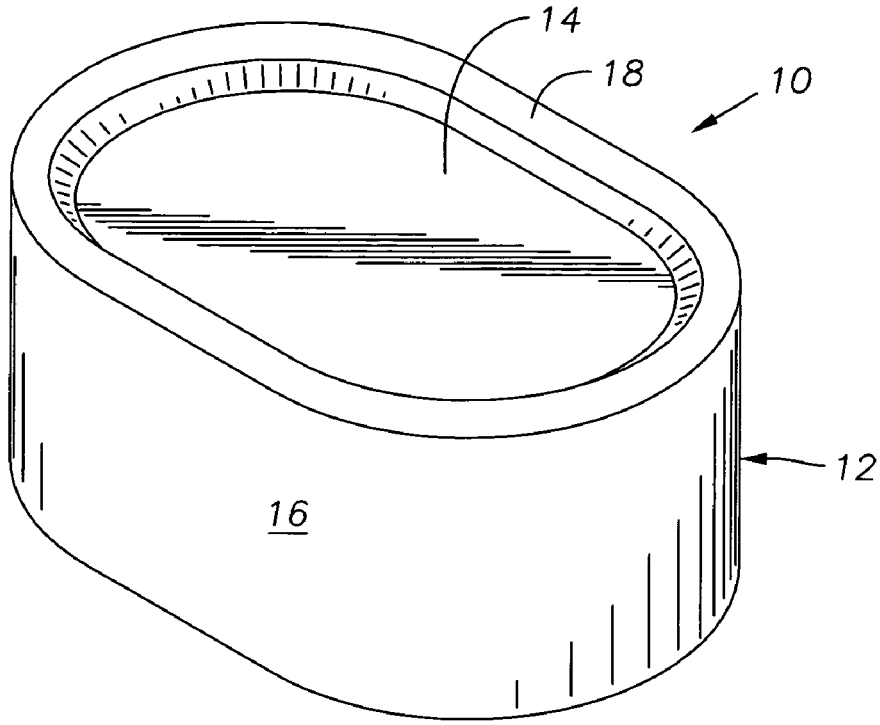
FIG. 1 is an isometric view of an exemplary cutter constructed in accordance with the present invention.
Figure 2:
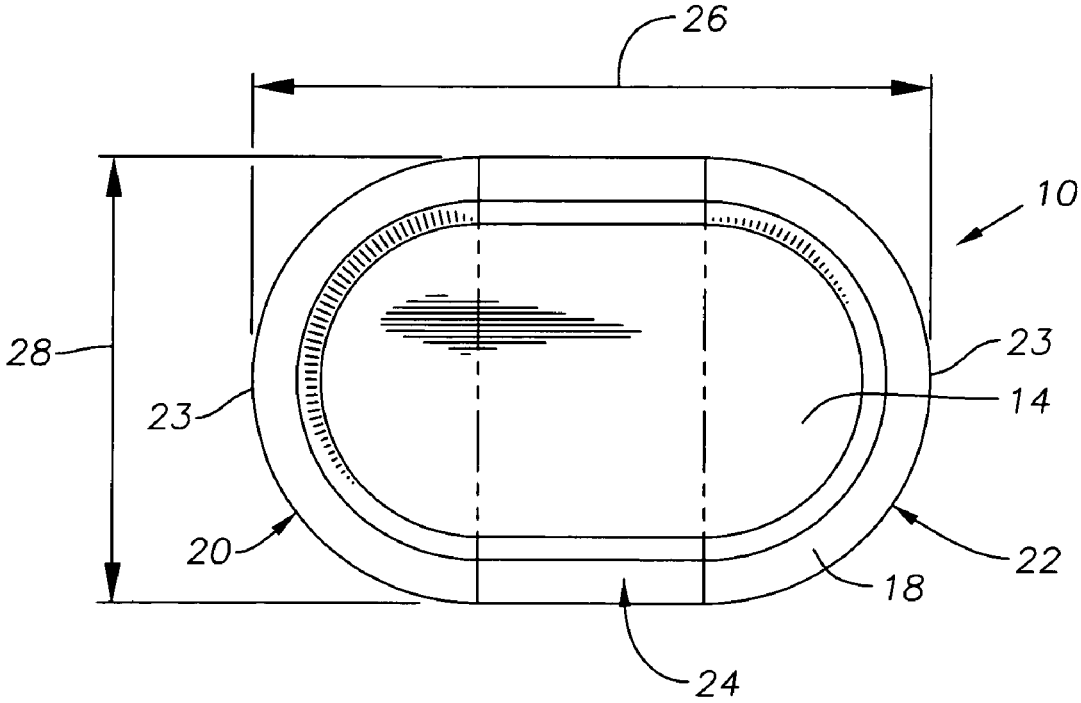
FIG. 2 is a top view of the cutter shown in FIG. 1.

FIGS. 1 and 2 depict an exemplary cutter 10 that is constructed in accordance with the present invention. The cutter 10 has a body 12 that is preferably formed of hardened carbide. However, the cutter 10 might also be formed of PDC, as is known in the art, or another substance suitable for use in downhole cutting. The body 12 features a cutting face 14 and a sidewall 16. Preferably, the cutter 10 features a raised chip-breaking edge 18 that is located proximate the outer circumference of the cutting face 14. When considered from the plan view offered by FIG. 2, the body 12 of the cutter 10 is generally made up of three sections: two end sections 20, 22 with end walls 23 that are semi-circular in shape, and a generally rectangular central section 24 that interconnects the two end sections 20, 22 to result in a rounded, rectangular "lozenge" shape for the cutter 10.

FIG. 2 also illustrates the currently preferred dimensions for the cutter 10. The cutter 10 has an overall length 26, as measured from the tip of one semi-circular section 20 to the tip of the other semi-circular section 22. The cutter 10 also has a width 28 that extends from one lateral side of the central section 24 to the other. The width 28 is also equal to the diameter of the semi-circular end sections 20, 22. In a currently preferred embodiment, the length 26 of the cutter 10 is approximately 1.5 times the width 28 of the cutter 10. A currently preferred width 29 for the cutter 10 is approximately ⅜41 .

Figure 3:
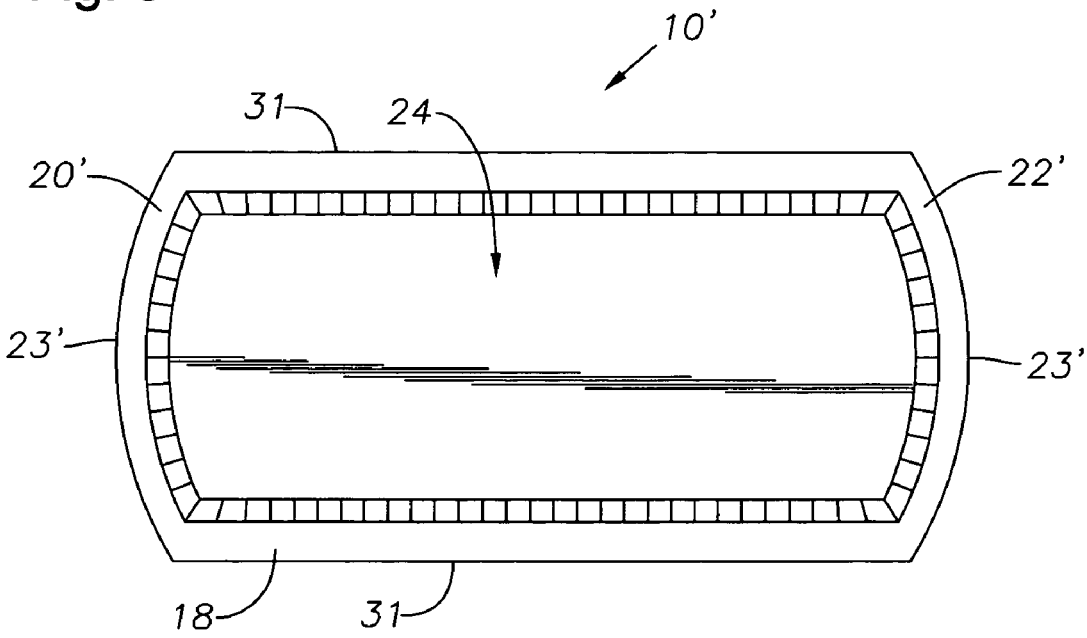
FIG. 3 is a top view of an exemplary cutter of alternate construction in accordance with the present invention.

FIG. 3 depicts an alternative embodiment for a cutter 10' which is constructed in accordance with the present invention. The cutter 10' is similar to the cutter 10 described previously. However, the end sections 20' and 22' are arcuate, but not semi-circular. The end sections 20' and 22' instead, have an end wall 23' with a larger radius of curvature and, therefore, represents an arc segment that is less than a semi-circle. In this embodiment, the length of the cutter 10' still exceeds the width of the cutter 10', and the preferred length-to-width ratios described above apply to this embodiment as well. It is noted that the end walls 23' of the end sections 20', 22' do not require any particular radius of curvature and, therefore, may present a relatively flattened curvature, as in FIG. 3, or a more pronounced curvature. Additionally, the radius of curvature for the end walls 23, 23' need not be a constant radius, but may otherwise be curvilinear. It is noted that the lateral sides 31 of the central section 24 are substantially straight and flat.

Figure 4:
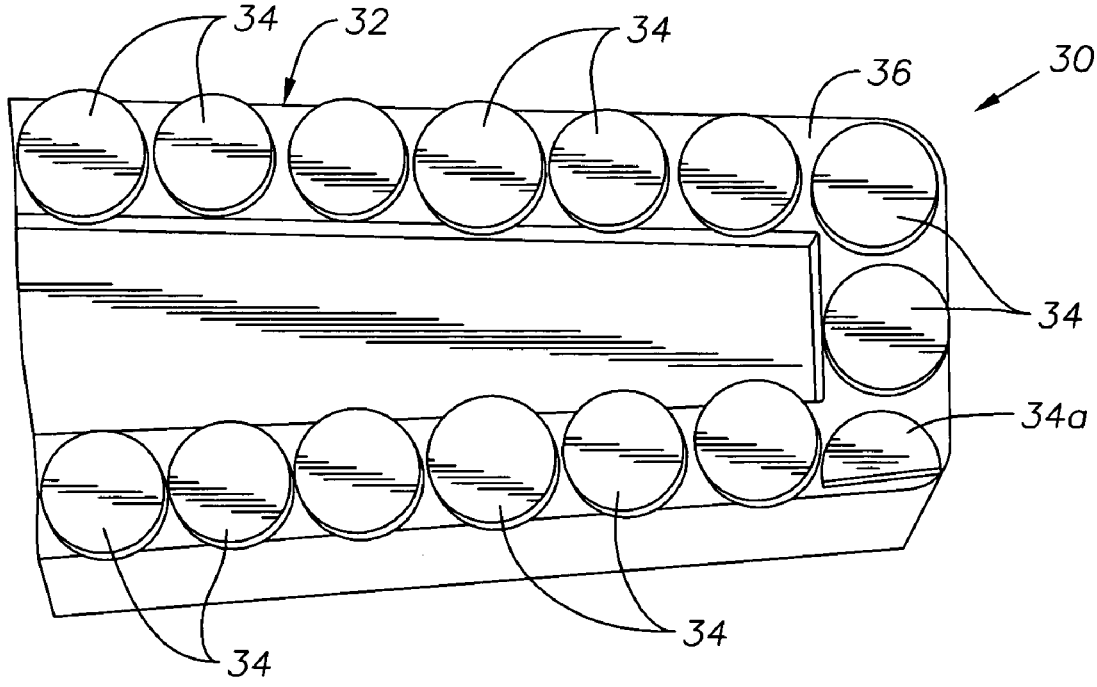
Fig. 4 (Prior Art)
FIG. 4 is an illustration of an exemplary cutting arm for a downhole cutter having a plurality of prior art circular cutters secured thereupon.

FIG. 4 illustrates an exemplary cutting arm, or cutting member, 30 having a raised cutting portion 32. The cutting arm 30 is of a type that is incorporated into a downhole cutter and used for rotary cutting into portions of the sidewall of a wellbore, as is known in the art. A plurality of prior art cutters 34 are affixed thereto having round-shaped cutting faces. It is noted that there is a significant amount of interstitial space 36 between the cutters 34 on the raised cutting portion 32. During downhole cutting or milling, the interstitial space 36 between the cutters 34 is highly susceptible to erosion damage. Particularly where the materials being milled or cut are highly ductile, such as those having high chrome and/or nickel content, the milled material tends to flow into the interstitial space 36 and erode away the arm 30. Also depicted in FIG. 4 is a half cutter 34*a* which is used to help accommodate proper spacing with the other cutters 34 upon the raised cutting portion 32. The use of half cutters 34*a* is problematic because there is minimal bonding area and, therefore, half cutters are very likely to break off of the cutting arm 30.

FIG. 5 depicts an exemplary cutting arm 30 having a plurality of cutters 10 of the type described previously with respect to FIGS. 1 and 2 affixed thereupon, in accordance with the present invention. The use of the rounded, rectangular cutters 10 results in less interstitial space 36 available on the raised portion 32 and as a result, less erosion of the arm 30. Additionally, the increased length 26 of the cutter 10 as compared to a cutter 34 means there is increased bond area between each cutter 10 and the arm 30 as compared to the prior art cutters 34. Cutters are typically affixed to a cutting arm by brazing and welding. The increased bond area results in cutters that are more securely affixed to the cutting arm 30. Additionally, the width 28 of the cutter 10 is the same as the width (diameter) of the conventional circular cutters 34, which allows the cutters 10 to be seated upon a cutting surface having a narrow width while providing improved bonding area and strength.

FIG. 6 depicts an exemplary arm 50 for a mandrel cutting tool. The arm 50 includes a proximal portion 52 having a pin opening 54 into which the arm 50 is pivotally attached to a cutting tool mandrel (not shown) and a distal cutting portion 56. The distal cutting portion 56, which is more clearly depicted in the close up view of FIG. 6A, includes a cutter retaining area 58 that is bounded by side surface 60 and shelf 62. Cutters 10 are accommodated inside the cutter retaining area 58 and leave very little interstitial space.

Figure 7:
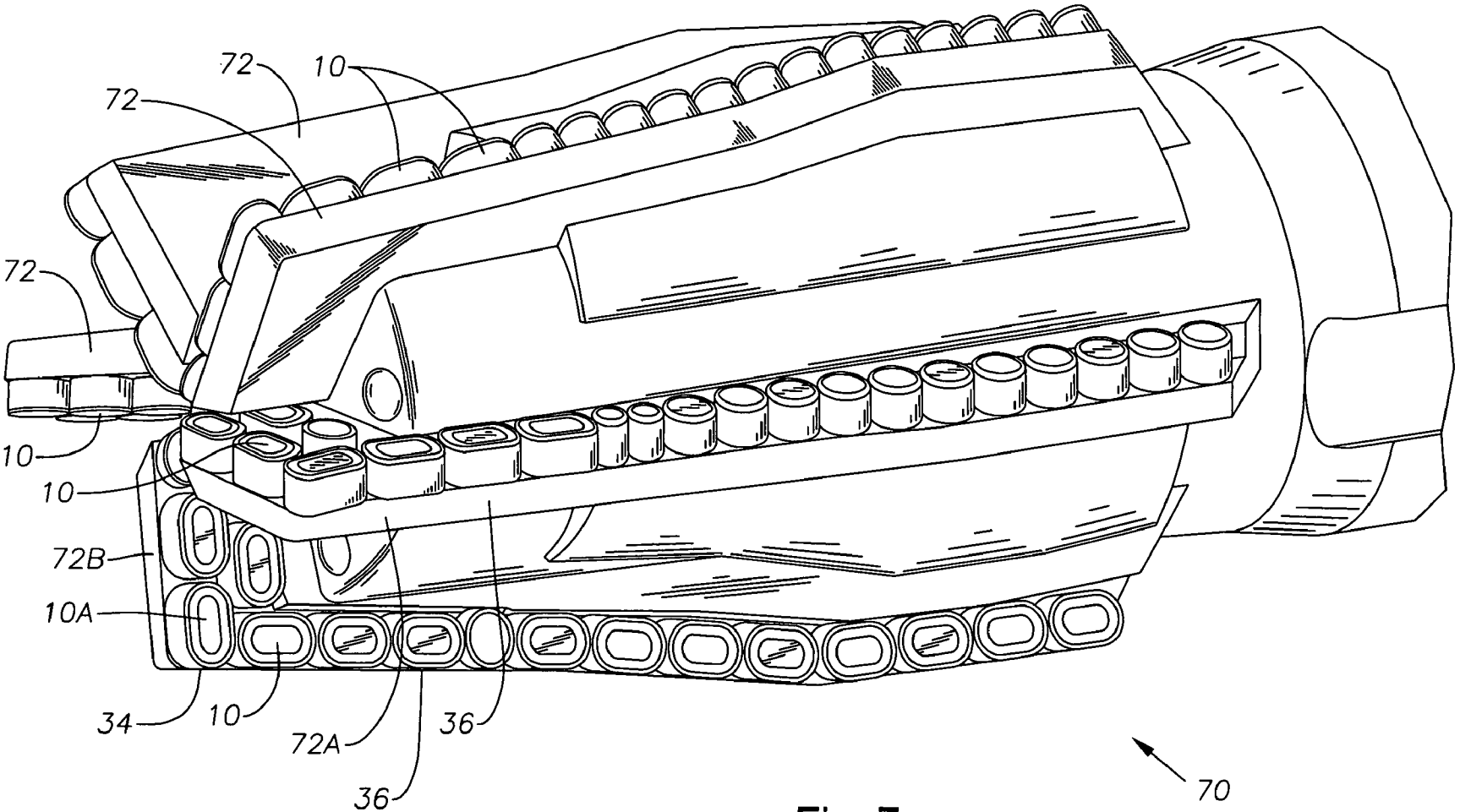
FIG. 7 illustrates an exemplary downhole rotary cutting mill which incorporates cutters in accordance with the present invention.

FIG. 7 illustrates an exemplary rotary cutting mill 70 of the type used in sidetracking operations to mill a lateral opening in wellbore casing. Cutting mills of this type are generally known in the art, and include the SILVERBACK™ window mill available commercially from Baker Oil Tools of Houston, Tex. The cutting mill 70 has five cutting blades, or arms, 72 that are rotated about hub 74 during operation. Each of these blades 72 has cutters 10 mounted upon them. It is pointed out that the blades 72 may include some rounded, conventional cutters 34 as well. It is noted that the cutters 10, 34 are mounted upon the cutting blades 72 in a manner such that the cutters are offset from one another in adjacent blades 72. For example, the distal tip of the edge of blade 72A has four cutters 10 that are arranged in an end-to-end manner. However, the neighboring blade 72B has the lead cutter 10A turned at a 90 degree angle to the other cutters 10, thereby causing the interstitial space 36 between the cutters 10, 10A, 34 to be staggered on adjacent blades 72. As a result of this staggering, the blades 72 will become less worn in the interstitial spaces 36.

Testing has shown that the use of cutters constructed in accordance with the present invention provide a number of advantages over conventional circular cutters. The rounded, rectangular shape of the cutters 10 allows them to be mounted upon narrow cutting surfaces, such as raised cutting portion 32. Such cutters are useful on cutting arms having narrow cutting surfaces as they provide for reduced cutting load while having sufficient bond area to remain secured during cutting. The chip breaker edge 18 serves to break up sections of earth material that may be formed during cutting.

Those of skill in the art will recognize that numerous modifications and changes may be made to the exemplary designs and embodiments described herein and that the invention is limited only by the claims that follow and any equivalents thereof.

What is claimed is:

1. A cutter for use upon a cutting arm of a downhole cutting device, the cutter comprising a cutter body having:
   - a first end section with an arcuate end wall;
   - a second end section with an arcuate end wall;
   - a central section interconnecting the first and second end sections, the central section having lateral sides that are substantially flat;
   - a cutting face presented by the first, second and central sections; and
   - a raised edge along the entirety of the outer circumference of the cutting face.

2. The cutter of claim 1 wherein the cutter body is fashioned of carbide.

3. The cutter of claim 1 wherein the cutter body is fashioned of PDC.

4. The cutter of claim 1 wherein the cutter body has a length measured from a tip of the first end section to a tip of the second end section and a width measured from opposite lateral sides of the central section, and wherein the length of the cutter is greater than the width.

5. The cutter of claim 4 wherein the length of the cutter is approximately 1.5 times the width of the cutter.

6. The cutter of claim 4 wherein the width of the cutter is approximately ⅜".

7. The cutter of claim 1 wherein the arcuate end walls of the first and second end sections are semi-circular.

8. The cutter of claim 1 wherein the arcuate end walls of the first and second end sections are arc segments.

9. A cutting tool for use in downhole cutting, the cutting tool comprising:

a cutting member for rotational cutting within an earth formation surrounding a wellbore;

at least one cutter secured to the cutting member, the cutter comprising a cutter body having:

a first end section having an arcuate end wall;

a second end section having an arcuate end wall;

a central section interconnecting the first and second end sections, the central section having lateral sides that are substantially flat;

a cutting face presented by the first, second and central sections; and a raised edge along the entirety of the outer circumference of the cutting face.

10. The cutting tool of claim 9 wherein the at least one cutter body is fashioned of carbide.

11. The cutting tool of claim 9 wherein the at least one cutter body is fashioned of PDC.

12. The cutting tool of claim 9 wherein there are multiple cutters secured to the cutting member.

13. The cutting tool of claim 9 wherein the at least one cutter has a length measured from a tip of the first end section to a tip of the second end section and a width as measured from opposite lateral sides of the central section, and wherein the length of the cutter is greater than the width.

14. The cutting tool of claim 13 wherein the length of each of said at least one cutter is approximately 1.5 times the width of said cutter.

15. The cutting tool of claim 13 wherein the width of said at least one cutter is approximately ⅜".

16. The cutting tool of claim 9 wherein arcuate end walls of the first and second end sections are semi-circular.

17. The cutting tool of claim 9 wherein the arcuate end walls of the first and second end sections are arc segments.

18. The cutting tool of claim 9 wherein the cutting member comprises a blade on a rotary mill.

19. The cutting tool of claim 9 wherein the cutting member comprises a mandrel cutting knife.

20. A cutting tool for use in downhole cutting, the cutting tool comprising:

a cutting member for rotational cutting within an earth formation surrounding a wellbore;

at least one cutter secured to the cutting member, the cutter comprising a cutter body having:

a first end section having a curvilinear end wall;

a second end section having a curvilinear end wall;

a central section interconnecting the first and second end sections, the central section having lateral sides that are substantially flat;

a cutting face presented by the first, second and central sections;

a raised edge along the entirety of the outer circumference of the cutting face, and wherein the at least one cutter has a length measured from a tip of the first end section to a tip of the second end section and a width as measured from opposite lateral sides of the central section, and wherein the length of the cutter is greater than the width.

21. The cutting tool of claim 20 wherein the at least one cutter body is fashioned of carbide.

22. The cutting tool of claim 20 wherein the length of each of said at least one cutter is approximately 1.5 times the width of said cutter.

23. The cutting tool of claim 20 wherein the width of said at least one cutter is approximately ⅜".

* * * * *